US006682038B2

(12) United States Patent
Golynsky

(10) Patent No.: US 6,682,038 B2
(45) Date of Patent: Jan. 27, 2004

(54) KEYBOARD SUPPORT WITH RETRACTABLE AUXILIARY SUPPORT PLATFORMS

(75) Inventor: Arkady Golynsky, Allentown, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 10/164,876

(22) Filed: Jun. 7, 2002

(65) Prior Publication Data

US 2003/0226947 A1 Dec. 11, 2003

(51) Int. Cl.[7] ..... B65D 19/00; B68G 5/00

(52) U.S. Cl. ..... 248/346.01; 248/918; 248/118; 108/43

(58) Field of Search ..... 248/346.01, 918, 248/118, 222.51, 225.11; 108/43

(56) References Cited

U.S. PATENT DOCUMENTS

| | | | | | |
|---|---|---|---|---|---|
| 5,490,039 | A | | 2/1996 | Helms | |
| 5,628,482 | A | | 5/1997 | Iravantchi et al. | |
| 5,636,822 | A | | 6/1997 | Hendershot et al. | |
| 5,655,743 | A | | 8/1997 | Gillis | |
| 5,692,815 | A | * | 12/1997 | Murphy | 312/283 |
| 5,704,698 | A | | 1/1998 | Lin | |
| 5,709,489 | A | | 1/1998 | Ambrose | |
| 5,730,408 | A | * | 3/1998 | McAllister et al. | 248/288.51 |
| 5,732,910 | A | * | 3/1998 | Martin | 248/118 |
| 5,832,840 | A | * | 11/1998 | Woof | 248/288.31 |
| D410,453 | S | | 6/1999 | Timm | |
| 5,961,231 | A | | 10/1999 | Ambrose | |
| 6,003,446 | A | * | 12/1999 | Leibowitz | 108/43 |
| 6,045,098 | A | | 4/2000 | Timm | |
| 6,079,676 | A | | 6/2000 | Hackett et al. | |
| 6,296,215 | B1 | * | 10/2001 | McCoy et al. | 248/284.1 |
| 6,390,432 | B1 | * | 5/2002 | VanderHeide et al. | 248/346.01 |
| 6,497,391 | B1 | * | 12/2002 | Timm | 248/118 |
| 2002/0104948 | A1 | * | 8/2002 | Hicks et al. | 248/346.01 |

* cited by examiner

*Primary Examiner*—Anita King
(74) *Attorney, Agent, or Firm*—Buchanan Ingersoll, P.C.

(57) ABSTRACT

A keyboard support includes one or more retractable auxiliary support platforms. The keyboard support is constructed of a keyboard platform and a bottom plate which include complementary interior surfaces which form one or more pockets therebetween into which the auxiliary support platforms are slidably retracted. Each auxiliary support platform further includes a top plate and a slider plate. The top plate has a top surface which matches that of the keyboard platform to provide a uniform appearance. The profile of the auxiliary support platforms generally matches that of the pockets so as to be substantially hidden when in the fully retracted position. The top plate is rotatable with respect to the slider plate, and also the keyboard support, so as to enlarge the useable work surface of the auxiliary support platform. When extended, the auxiliary support platform top surface is generally flush with that of the top surface of the keyboard platform, separated only by the relative small thickness of the keyboard platform, because of the pockets formed in the keyboard support.

11 Claims, 5 Drawing Sheets

KEYBOARD SUPPORT WITH RETRACTABLE AUXILIARY SUPPORT PLATFORMS

BACKGROUND OF THE INVENTION

1. Technical Field

The invention is directed to a keyboard support device, and more particularly, to a keyboard support having one or more retractable auxiliary support platforms associated therewith.

2. Description of the Prior Art

In the computer industry it is well known to provide a keyboard support which is typically retractable from the underside of the computer desk at which the computer is situated, to provide a more ergonomic work area for the user. For example, mounting a keyboard tray, on which a keyboard rests, which tray is slidable underneath the top surface of the desk, or is connected to a positionable extension arm, is well known in the art. Additionally, it is known to provide an auxiliary support platform, which is used for supporting a mouse, track ball, other pointing device or other peripheral computer equipment, or note pads and the like.

Typically the auxiliary platform is either integral with the keyboard support or is provided as a separate platform for supporting the mouse in close proximity to the keyboard and computer desk. The mouse support platform is generally the size of a common mouse pad so that a mouse pad may rest thereon, or the top surface of the auxiliary support is such that the ball of the mouse is readily rollable thereon to operate the mouse without the need of a separate mouse pad. It is typical to provide such a mouse platform on either side of the keyboard so that the mouse may be used by either a right- or left-handed person. A mouse pad may also be connected to the keyboard support and positionable about either side of the keyboard support. U.S. Pat. Nos. 5,730,408 and 6,086,034 are examples of such a positionable mouse support platform, which patents are assigned to the present assignee and hereby incorporated by reference herein.

In each of these prior art devices, the mouse support or auxiliary support platform generally remains visible and accessible at all times. Thus even when a user is not using a pointing device or has no need for the additional work space, the mouse support pad still is attached to the keyboard support and occupies space on the users desk area.

While it is known to provide retractable mouse pad supports, typically the user has to decide on which side of the keyboard the auxiliary support pad is to be attached. There is also available a separate support platform which slides underneath the keyboard support such that one end of this platform projects beyond the side of the keyboard support providing an area on either side of the keyboard for the auxiliary support platform. However, again only one side is available for supporting the peripheral equipment and the operator must disassemble and/or reposition the device each time a different user wants to reconfigure the auxiliary support platform to the other side of the keyboard support.

It is therefore an object of the present invention to provide a keyboard support having one or more auxiliary support platforms associated therewith.

It is another object of the present invention to provide a keyboard support having integral auxiliary support platforms which are readily retractable from a use to a nonuse position.

It is a further object of the present invention to provide a keyboard support having mouse support pads of uniform appearance with respect to each other.

It is a still further object of the present invention to provide a keyboard support having a pair of auxiliary support platforms, each of which are independently retractable with respect to the keyboard platform.

SUMMARY OF THE INVENTION

In accordance with the above and other objects and advantages of the present invention, a keyboard support comprises a keyboard platform having a keyboard surface. A bottom plate is secured to the keyboard platform on a side opposite the keyboard surface such that a pocket is formed between the keyboard platform and the bottom plate. An auxiliary support platform is slidably disposed within the pocket, the auxiliary support platform comprising a slider plate slidably engaged with the bottom plate and a top plate rotatably attached to the slider plate such that the auxiliary support platform is retractable from the pocket, and the top plate is rotatable with respect to the keyboard platform to maximize the auxiliary support area.

BRIEF DESCRIPTION OF THE DRAWINGS

Various other objects, features and advantages of the present invention, in addition to the above, will become readily apparent to those skilled in the art, by reading the following detailed description in conjunction with the drawings, which are shown by way of example only, wherein.

DESCRIPTION OF THE PREFERRED EMBODIMENTS

Figure 1:
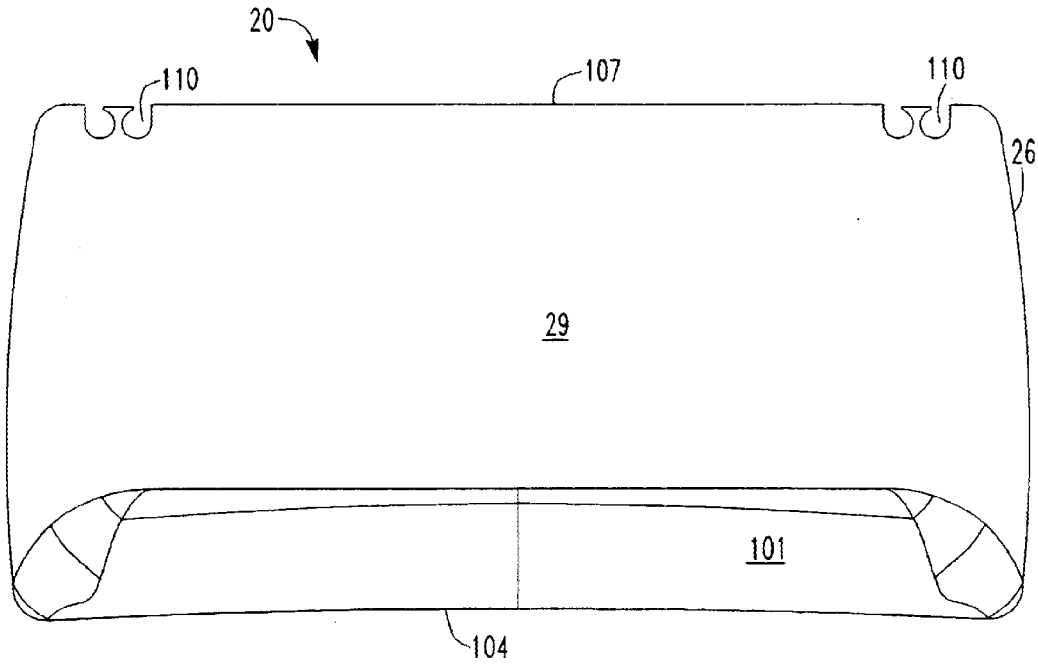
FIG. 1 is a top view of a first embodiment of the keyboard support of the present invention having the auxiliary support platforms in a retracted position.
Figure 2:
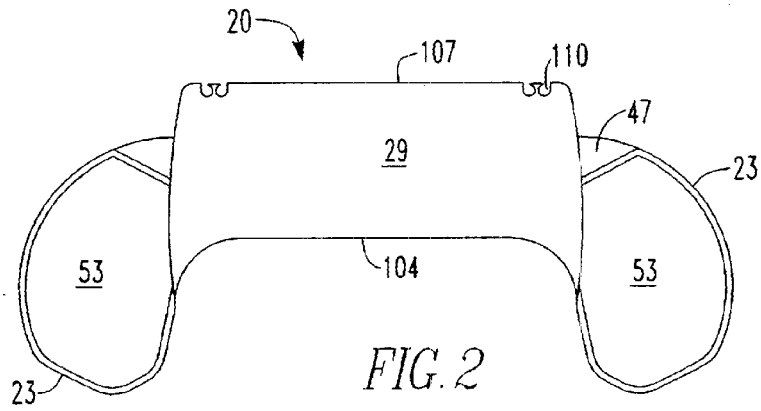
FIG. 2 is a top view of the keyboard support of the present invention showing two auxiliary support platforms or mouse pads fully extended.
Figure 4A:
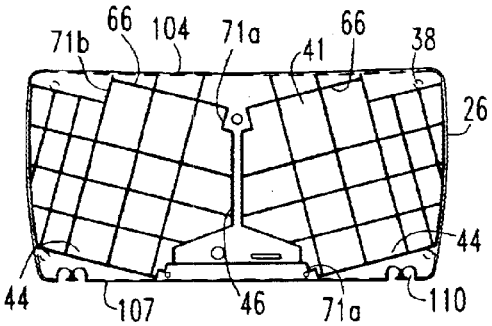

Referring now to the drawings in detail, wherein like characters refer to similar components throughout, FIG. 1 shows a top view of a keyboard support 20 of the present invention. As shown in FIG. 2, one or more retractable auxiliary support platforms 23 are provided and are slidably retractable within either side of the keyboard support in a respective pocket formed within the keyboard support, as will be more fully described hereinafter. The keyboard support 20 comprises a keyboard platform 26 having a top or keyboard surface 29 and a bottom plate 32 (See FIG. 5). The bottom plate 32 is secured to the keyboard platform 26 such as by screws (not shown) which pass through openings 35 (FIG. 5B) in the bottom plate 32 and are self-threaded into corresponding openings 38 (FIG. 4A) in the underside or interior surface 41 of the keyboard platform 26.

Figure 3:
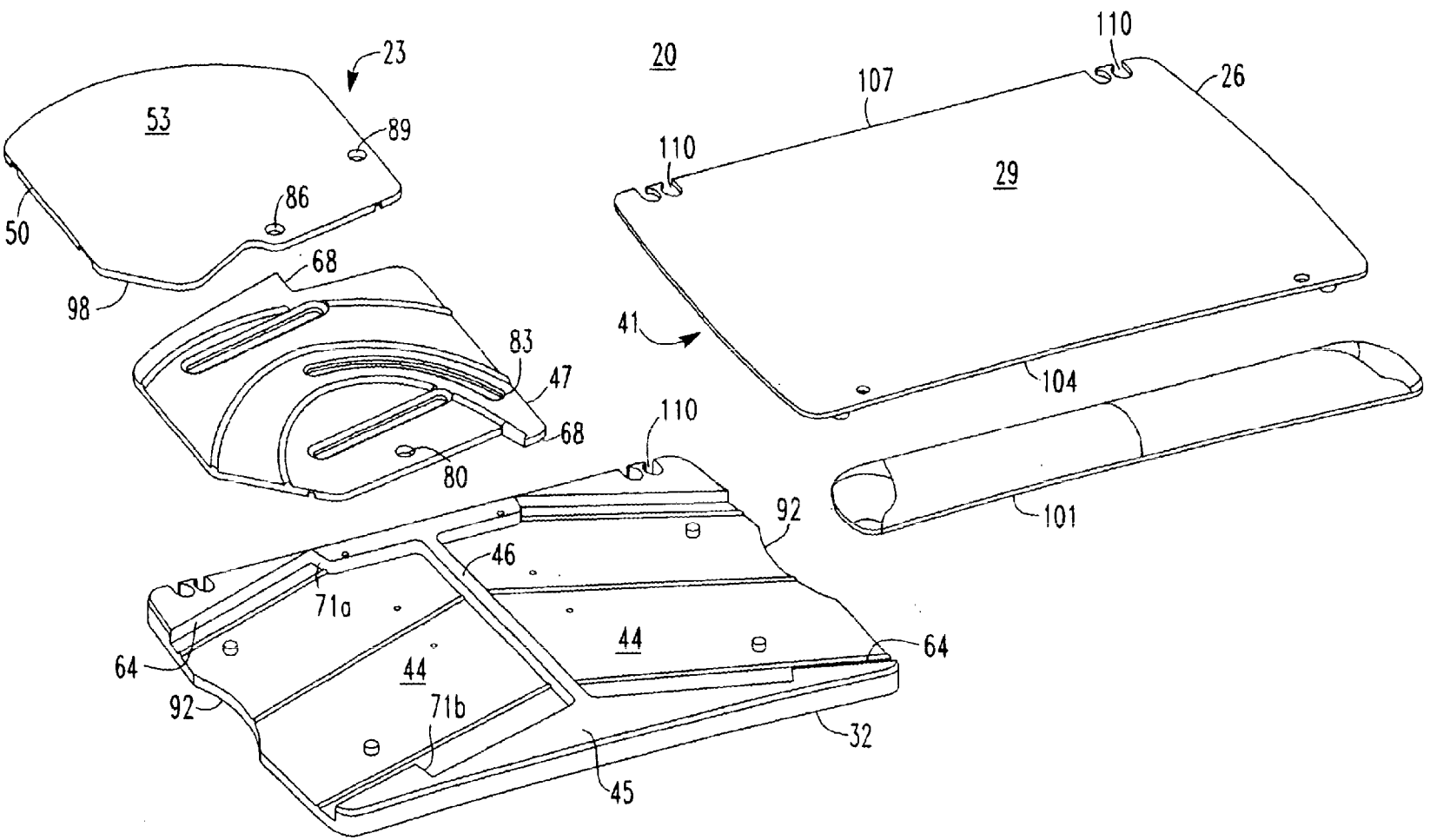
FIG. 3 is an exploded view of a second embodiment of the keyboard support of present invention showing one mouse pad assembly.
Figure 4B:
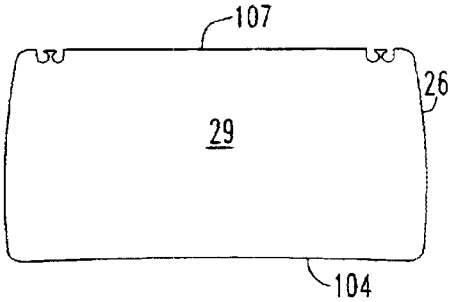
FIG. 4, consisting of FIGS. 4A and 4B, is a detailed view of the interior and exterior surfaces, respectively, of the keyboard platform.
Figure 5B:
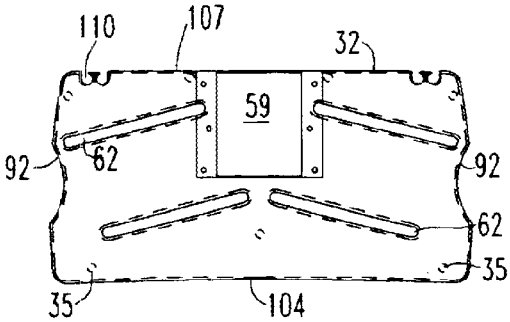
FIG. 5, consisting of FIGS. 5A and 5B, is a detailed view of the interior and exterior, respectively, of the keyboard bottom plate.
Figure 5A:
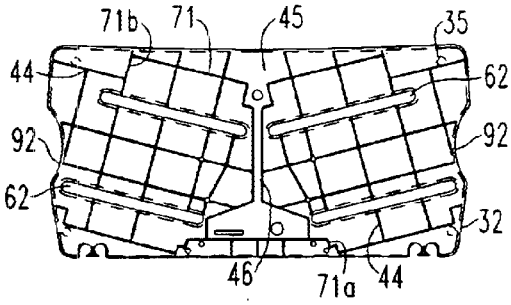

As shown in the exploded view of FIG. 3, the keyboard support 20 of the present invention comprises a keyboard platform 26 having a top or keyboard surface 29 and a bottom plate 32 secured to an underside or interior surface 41 of the keyboard platform 26 such that one or more pockets 44 are formed between the respective interior surfaces 41, 45 of the keyboard platform 26 and the bottom plate 32, respectively. One or more auxiliary support platforms 23, commonly referred to as mouse pad supports, are slidably received within the pockets 44. Each auxiliary support platform 23 comprises a slider plate 47 (FIG. 6) and a top plate 50 (FIG. 7), the top plate 50 having a top surface 53 which generally matches the appearance of that of the keyboard surface 29. In addition, the top plate 50 is rotateably attached to the slider plate 47, as will be describe more fully hereinafter. As shown in FIG. 5A, the bottom surface 45 of the bottom plate 32 for the keyboard support 20 has an attachment area 59 for attaching the keyboard platform 20 to a work surface, such as by an articulated arm (not shown), as is well known in the art. As shown in FIG. 5B, the bottom plate 32 has one or more slots 62 for slideably engaging the slider plate 47 of the mouse pad support 23, as also will be more fully described hereinafter. As illustrated by the differing embodiments of FIGS. 1 and 3, the slots may be disposed in the slider plate and the tabs on the keyboard platform and/or the bottom plate. In either case, each auxiliary support platform 23 is independently slideable with respect to the keyboard platform 26.

As shown in more detail in the exploded view of FIG. 3, the interior surface 45 of bottom plate 32 preferably includes a pair of channels 64 separated by a wall member or rib 46, for receiving the auxiliary support platform 23 therein. Generally the profile of the channel 64 matches the profile of the slider plate 47, the slider plate including a pair of tabs 68 which engage the sides 71 of the pocket when the auxiliary support is in a fully retracted (nonuse) position (71*a*) and the fully extended (use) position (71*b*). The underside or interior surface 41 of the keyboard platform 26 has a generally matching or complementary configuration to create the pocket(s) into which the auxiliary support platforms are slidably retracted. The interior surface 41 (FIG. 4A) has a first channel 66 of complimentary shape to the second channel 64 of the bottom plate to form these pockets 44.

Figure 6A:
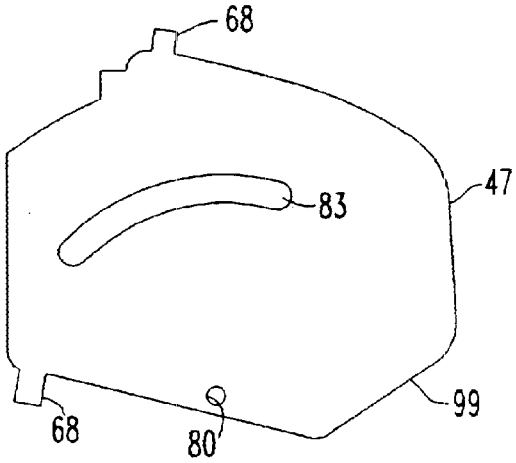
FIG. 6, consisting of FIGS. 6A and 6B, shows the top and bottom, respectively, of the mouse pad slider plate.
Figure 7A:
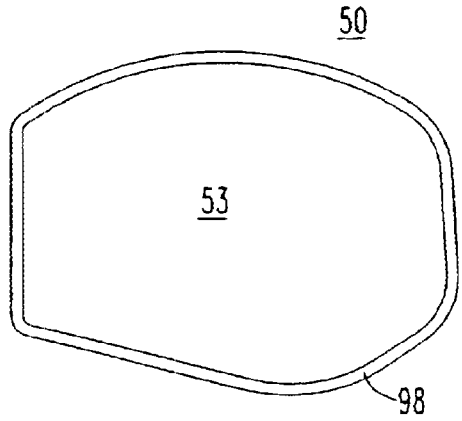
FIG. 7, consisting of FIGS. 7A and 7B, shows the top and bottom, respectively, of the mouse pad top plate.
Figure 6B:
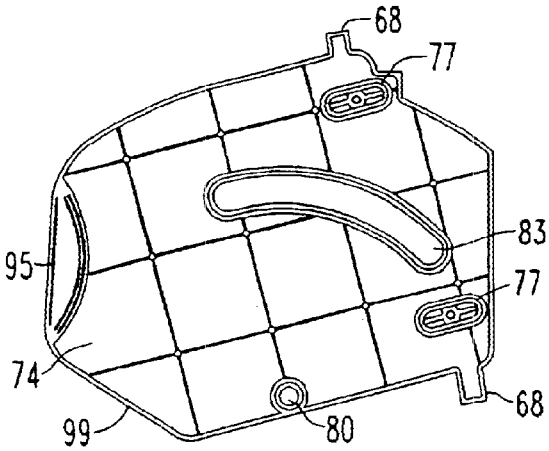
Figure 7B:
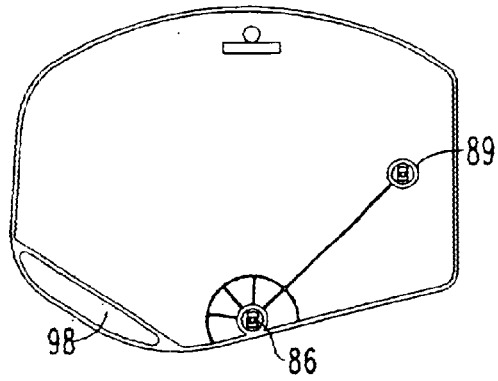
Figure 8:
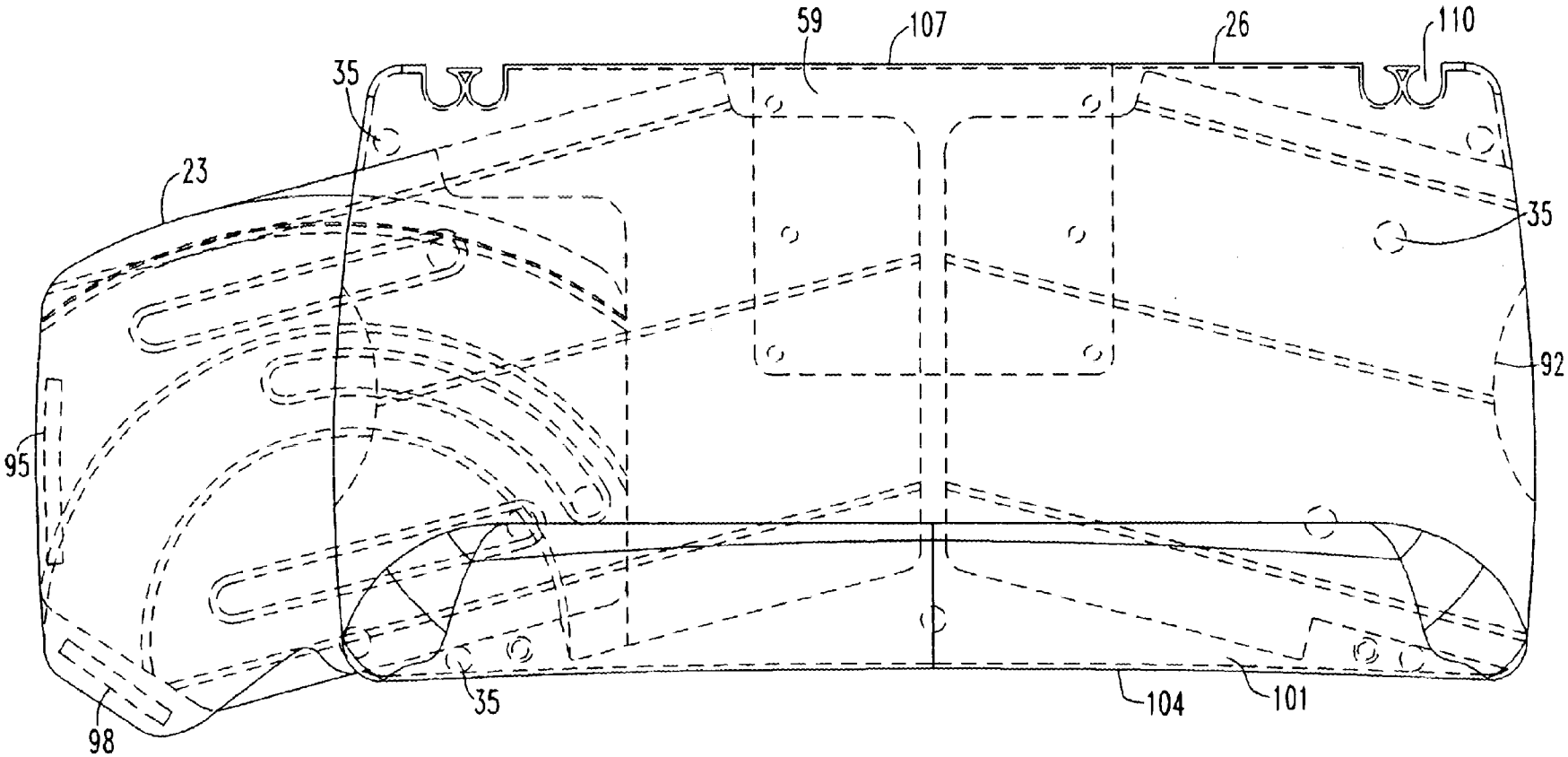
FIG. 8 is a schematic representation of the keyboard support of the present invention showing the mouse pad support in the interior thereof and partially retracted therein.

As shown in FIGS. 6 and 7, each auxiliary support platform 23 comprises a bottom or slider plate 47 (FIG. 6) and a top plate 50 (FIG. 7) or mouse support platform. On the underside 74 of the slider plate 47 are one or more tabs 77 which correspond to the slots 62 in the bottom plate 32 of the keyboard support 20. This enables the auxiliary or mouse pad support to slide in or out of the pocket 44 according to the desires of the user. Preferably a retractable mouse pad support is provided on both sides of the keyboard platform (See FIG. 2). Thus a user may extend either one or both of the auxiliary supports 23 to support a mouse or other pointing device, additional peripheral equipment or even notes and writing implements for easy access by the computer user.

Additionally, the top or rotator plate 50 is rotatably secured to the slider plate 47. The slider plate includes a pivot hole 80 and an arched slot 83, whereas the rotator plate 50 includes a pivot point 86 and a rotation tab 89 which operatively fit into the pivot hole 80 and the arched slot 83, respectively. When the auxiliary support platform 23 is retracted from the pocket 44 in the keyboard support 20, the top plate 50 can then be rotated with respect to the slider plate 47, and also with respect to the keyboard support 20, as shown in FIG. 2, for example. When fully extended, the auxiliary support platform top surface 53 is generally flush with that of the top surface 29 of the keyboard platform 26, separated only by the relative small thickness of the keyboard platform (approximately ¼" to ⅜"), by means of the pockets 44 formed in the keyboard support.

Referring again to FIG. 5B, the bottom plate 32 of the keyboard support 20, on either end thereof where the auxiliary support platform 23 is retracted into the pocket 44, includes a notched area 92. This notched area 92, which is not visible when the keyboard platform is attached to the bottom plate (as shown in FIGS. 1 and 2), allows the user to grasp a corresponding portion 95 the underside 74 of the slider plate 47 which extends beyond the notched area 92 in order to retract the auxiliary support platform 23 from the pocket 44. Similarly, a grasp portion 98 is provided on the underside of the top plate 50 for the user to more easily slide the top plate with respect to the bottom plate 50. This grasp portion 98 is overhangs an edge 99 of the slider plate 47 and is not visible when viewed from the top providing a "clean" appearance for the platform 26.

As shown in FIG. 1 preferably the keyboard support includes a palm rest 101 on a front edge 104 thereof. Preferably the palm rest 101 and the front edge 104 of the keyboard platform 26 and bottom plate 29 are arched so as to accommodate the user sitting at a desk, for example. On the back edge 107 of the keyboard platform 26 and bottom plate 29 are wire management channels 110. These secure the wires from the keyboard, mouse, other pointing devices or other peripheral equipment, so as to keep them out of the way when the keyboard and mouse are put in a useable position.

By way of example only and without limiting the uses to which the keyboard support of the present invention may be utilized, a digital camera may be supported by one of the auxiliary support platforms and operatively connected to the computer as the user downloads digital images from the camera to the personal computer's hard drive. Also by way of example, a personal digital assistant (PDA) or handheld computer may be supported by one of the auxiliary support platforms for exchange of information between the PDA and the personal computer as the operator navigates the operations software for accomplishing these tasks by use of the pointing device supported on the other auxiliary support platform.

While specific embodiments of the invention have been described in detail, it would be appreciated by those skilled in the art that various modifications and alterations would be developed in light of the overall teachings of the disclosure. Accordingly, the particular arrangements disclosed are meant to be illustrative only and not limiting as to the scope of the invention, which is to be given the full breath of the appended claims and any and all equivalents thereof.

What is claimed:

1. A keyboard support comprising:

a keyboard platform having a keyboard surface, a bottom plate secured to the keyboard platform on a side opposite the keyboard surface such that a pocket is formed between the keyboard platform and the bottom plate; and an auxiliary support platform slidably disposed within the pocket, the auxiliary support platform comprising a slider plate slidably engaged with the bottom plate and a top plate attached to the slider plate such that the auxiliary support platform is retractable from the pocket.

2. The keyboard support as recited in claim 1, wherein the keyboard platform has a first interior surface on the side opposite the keyboard surface, the first interior surface having a first channel, the bottom plate has a second interior surface having a second channel such that the first channel has a shape complementary to the second channel whereby the pocket is formed.

3. The keyboard support as recited in claim 2, wherein the bottom plate further includes a slot and the slider plate includes a tab slidably engaged with the slot.

4. The keyboard support as recited in claim 3, wherein the slider plate includes a pivot hole and an arced slot disposed therein, and the top plate includes a pivot point rotatably connected with the pivot hole and a rotating tab slidably engaged with the arched slot whereby the top plate is rotatable with respect to the slider plate.

5. The keyboard support as recited in claim 4, further comprising a palm rest attached to the keyboard surface along a front edge thereof.

6. The keyboard support as recited in claim 4, further comprising a wire management channel in the keyboard support along a back edge thereof.

7. The keyboard support as recited in claim 2, wherein the shape of the auxiliary support platform generally conforms to the shape of the pocket, the auxiliary support further including a stop tab for engaging a portion of the keyboard in the pocket when the auxiliary support is in a fully retracted position.

8. The keyboard support as recited in claim 2, wherein the top plate is rotatable with respect to the keyboard platform.

9. The keyboard support as recited in claim 1, further comprising a pair of auxiliary support platforms, wherein each of said auxiliary support platforms are independently slideable with respect to the keyboard platform.

10. The keyboard support as recited in claim 9, wherein said keyboard support platform includes a pair of pockets, each of said pair of auxiliary support platforms disposed in each of said pockets.

11. The keyboard support as recited in claim 10, wherein said pair of pockets are separated by a rib.

* * * * *

UNITED STATES PATENT AND TRADEMARK OFFICE

CERTIFICATE OF CORRECTION

PATENT NO. : 6,682,038 B2
DATED : January 27, 2004
INVENTOR(S) : Arkady Golynsky It is certified that error appears in the above-identified patent and that said Letters Patent is hereby corrected as shown below:

Column 5,
Line 15, change “arced” to -- arched --.

Signed and Sealed this

Thirteenth Day of April, 2004

JON W. DUDAS
*Acting Director of the United States Patent and Trademark Office*